United States Patent [19]

Lawhorn

[11] 4,327,884

[45] May 4, 1982

[54] ADVANCED AIR-TO-SURFACE WEAPON

[75] Inventor: William S. Lawhorn, Rockwall, Tex.

[73] Assignee: The United States of America as represented by the Secretary of the Air Force, Washington, D.C.

[21] Appl. No.: 114,533

[22] Filed: Jan. 23, 1980

[51] Int. Cl.[3] ..... F41G 7/00; F42B 15/02; F42B 15/16

[52] U.S. Cl. ..... 244/3.1; 102/374; 102/436; 244/3.24

[58] Field of Search ..... 244/3.24, 3.1, 3.22, 244/3.15, 130, 32; 102/38 NC, 69, 92.1–92.7, DIG. 7, 49.3, 436, 489, 374, 501

[56] References Cited

U.S. PATENT DOCUMENTS

| | | | |
|---|---|---|---|
| 2,691,495 | 10/1954 | Chiroky | 244/3.24 |
| 2,967,034 | 1/1961 | Eyre | 244/36 X |
| 3,120,361 | 2/1964 | Rube et al. | 244/36 X |
| 3,625,459 | 12/1971 | Brown | 244/36 |
| 4,176,813 | 12/1979 | Headley | 244/130 |

FOREIGN PATENT DOCUMENTS

| | | | |
|---|---|---|---|
| 2609590 | 9/1977 | Fed. Rep. of Germany | 102/69 |
| 1027919 | 4/1966 | United Kingdom | 102/69 |

OTHER PUBLICATIONS

"Modular Weapons", by Hendricks Weapons Technology Ordance, Jan., Feb. 1973.

The Aerodynamic Design of Aircraft, 1978, pp. 71–77.

*Primary Examiner*—Harold J. Tudor

*Attorney, Agent, or Firm*—Donald J. Singer; Arsen Tashjian

[57] ABSTRACT

An unconventional advanced air-to-surface weapon of monowing configuration, and having a symmetrical, high lift fuselage of lenticular (i.e., biconvex or oblate) cross section, with a width-to-thickness fineness of approximately 2.5. The longitudinal profile is modified Sears-Haack in two dimensions, truncated at the base for a rocket nozzle. The weapon comprises a nose portion modular forebody, a weapon payload portion modular midbody, and an aft boattail modular portion which are combined into one unit that is selectively separable into its modular components when used. A variation of this weapon is also taught which features a semi-lenticular fuselage cross section (i.e., one flat side) and a width-to-thickness fineness of approximately 2.1.

2 Claims, 17 Drawing Figures

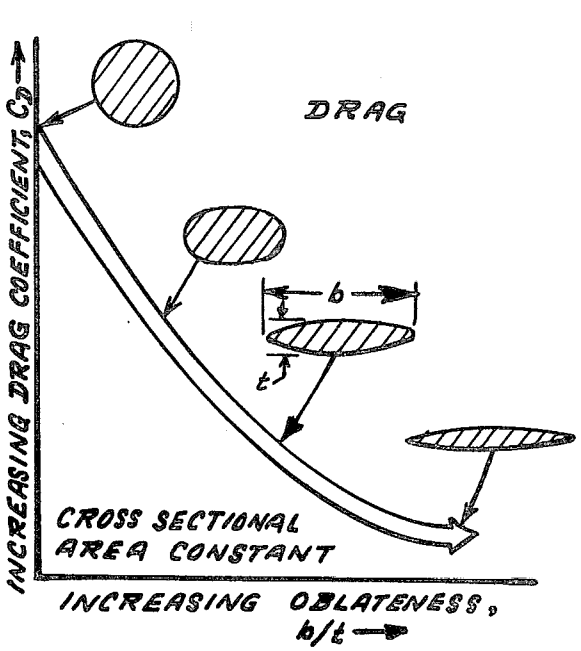
FIG. 1-B
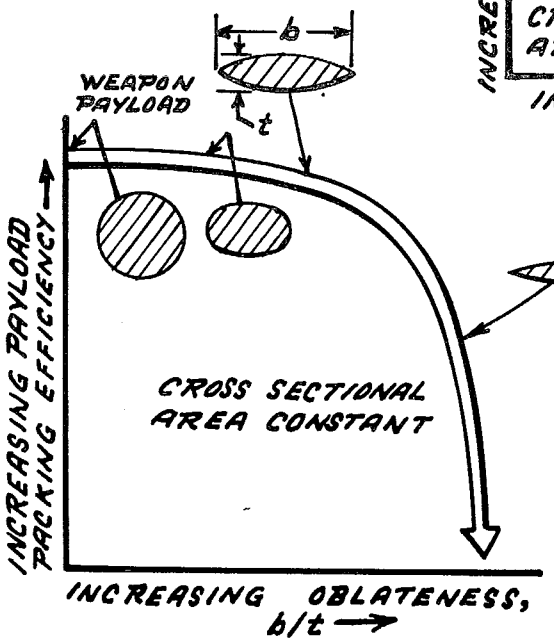
FIG. 2
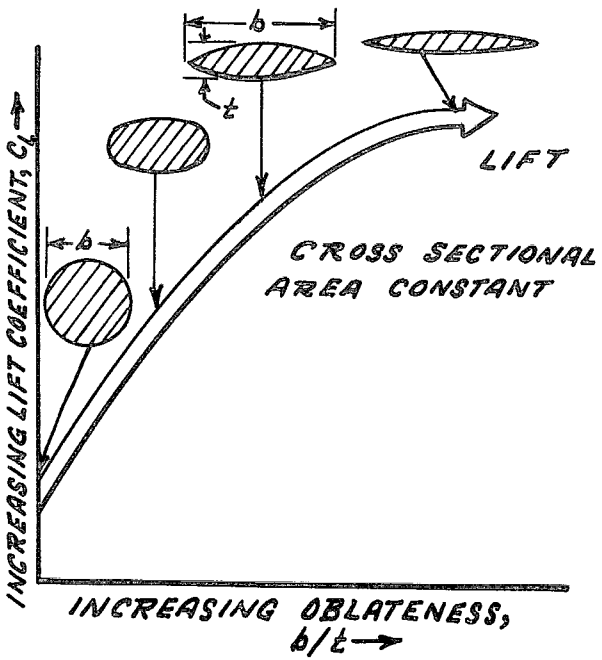
FIG. 1-A

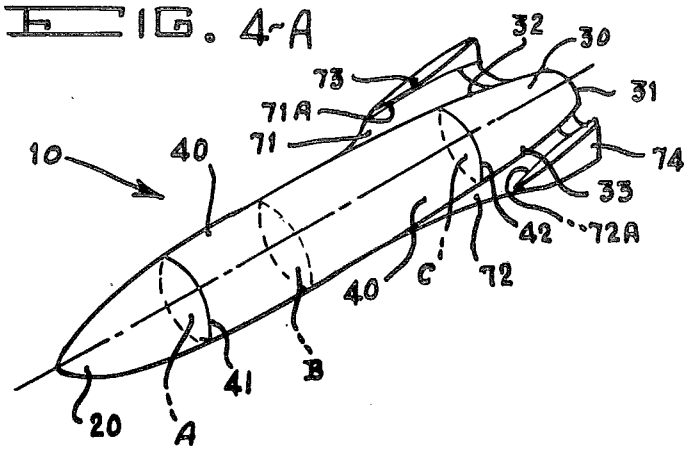
FIG. 4-A
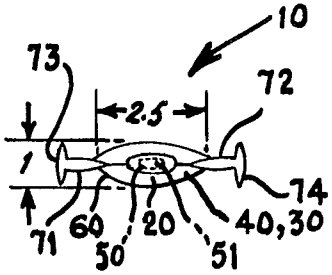
FIG. 4-D
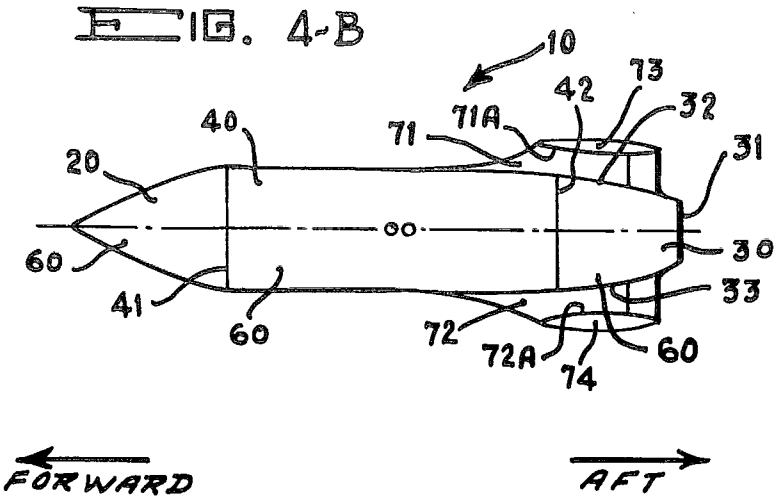
FIG. 4-B
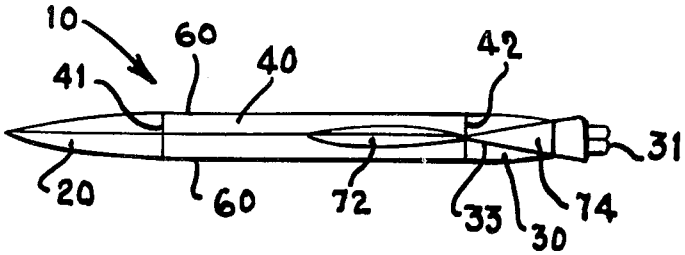
FIG. 4-C

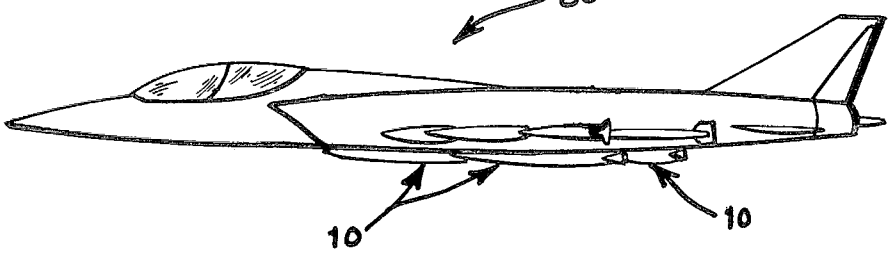
FIG. 5-A
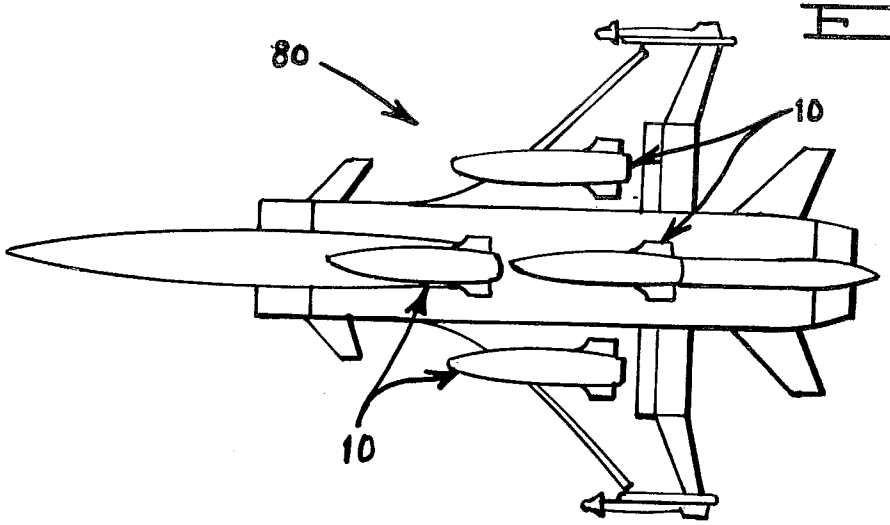
FIG. 5-B
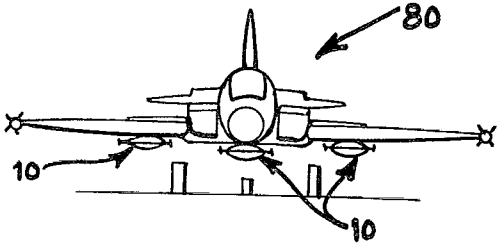
FIG. 5-C

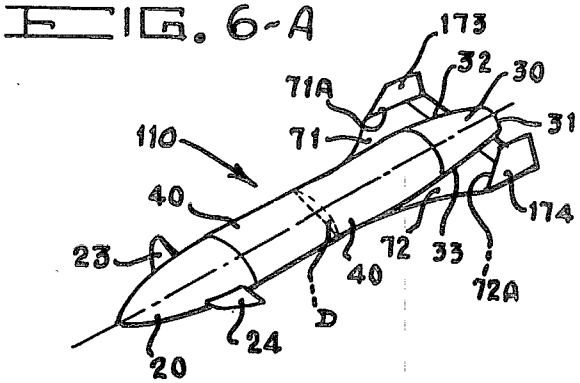
FIG. 6-A
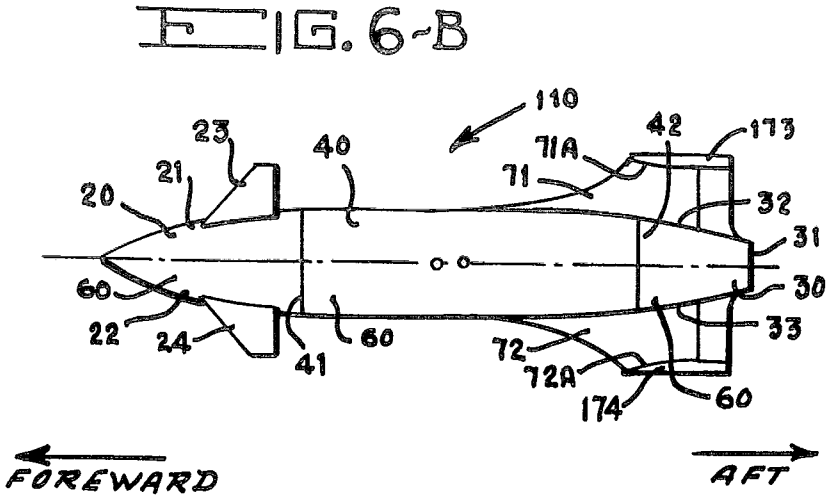
FIG. 6-B
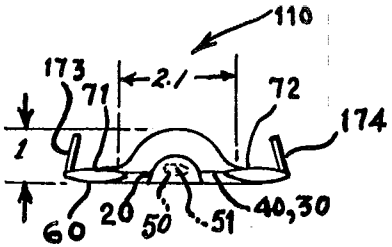
FIG. 6-D
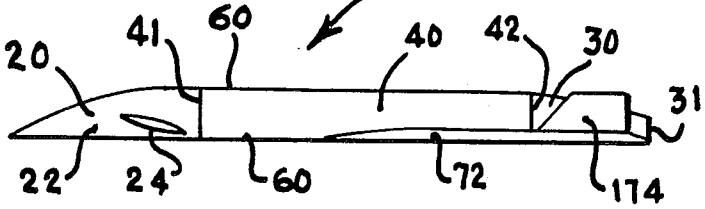
FIG. 6-C

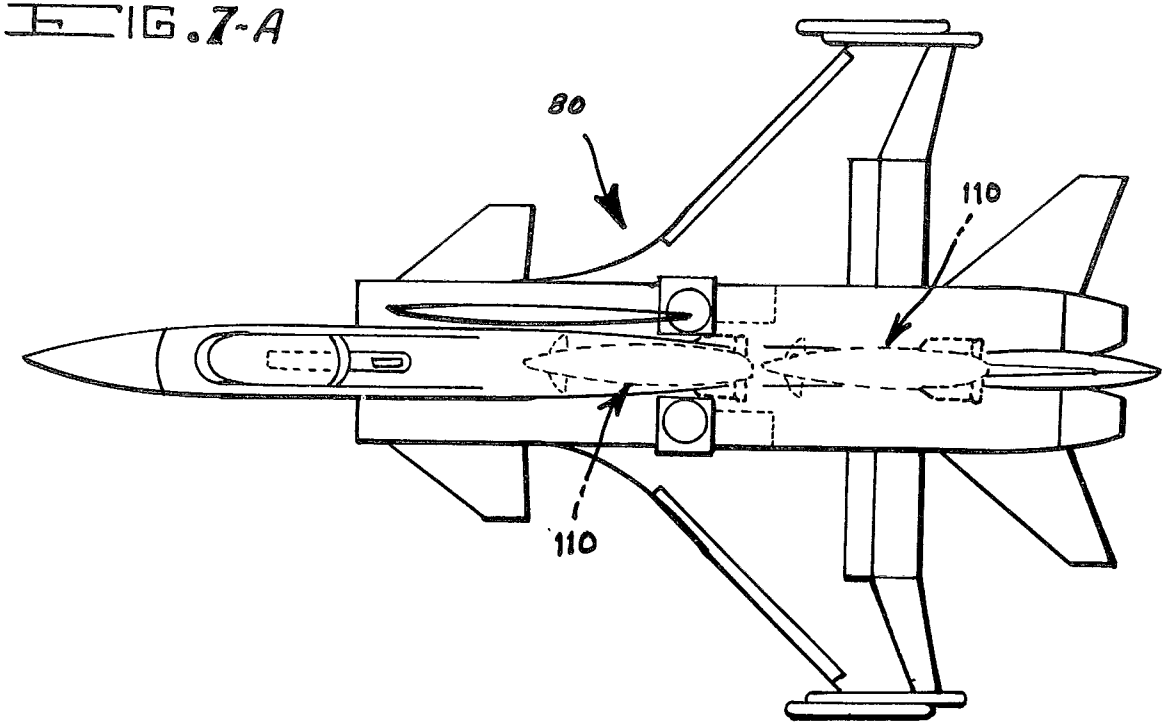
FIG. 7-A
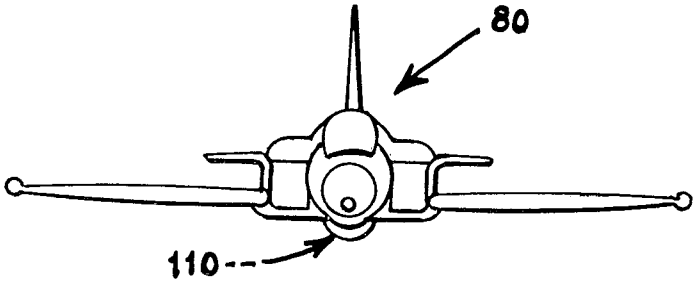
FIG. 7-B

ADVANCED AIR-TO-SURFACE WEAPON

STATEMENT OF GOVERNMENT INTEREST

The invention described herein may be manufactured and used by or for the Government for governmental purposes without the payment of any royalty thereon.

BACKGROUND OF THE INVENTION

This invention relates to an advanced air-to-surface weapon.

A universal malady of prior art air-to-surface weapons is the inability to effectively engage multi-element targets with a single weapon. Additionally, without exceptions, existing air-to-surface weapons cannot endure the aero-thermodynamic rigors of exposed supercruise captive carriage. Further, lack of adaptability to low drag conformal carriage and resulting high carriage drag are two other major shortcomings. Also, relatively low payload-standoff capabilities round out the major "negatives" of existing weaponry.

My inventive advanced air-to-surface weapon solves each and all of the foregoing problems, and thereby constitutes a significant advance in the state-of-the-art.

SUMMARY OF THE INVENTION

My invention provides an air-to-surface weapon which has low carriage drag, improved stealth (low radar signature) characteristics, excellent payload-standoff range capacility, good free flight maneuverability, and is capable of being carried conformally, or tangentially, on the proposed next generation of supercruising tactical fighter aircraft.

Accordingly, the principal object of this invention is to teach the structure of a preferred embodiment of such a unique air-to-surface weapon.

Another object of this invention is to provide a variation of the preferred embodiment of this air-to-surface weapon.

These objects, as well as other objects, of this invention will become readily apparent after a consideration of the description of the invention, together with reference to the Figures of the drawings.

DESCRIPTION OF THE DRAWINGS

FIGS. 1A, 1B and 2 are charts which show, respectively, that with the cross sectional area of the air-to-surface weapon remaining constant regardless of shape, how the lift coefficient increases with increasing oblateness, and how the drag coefficient decreases with increasing oblatenss, and also how payload packaging efficiency decreases with increasing oblateness;

FIGS. 4A, 4B, 4C and 4D are various views, in simplified pictorial and schematic form, of the preferred embodiment of my inventive advanced air-to-surface weapon;

FIGS. 5A, 5B and 5C are various views, in simplified pictorial and schematic form, of a representative proposed next generation of supercruising tactical fighter aircraft carrying four of my advanced air-to-surface weapons in a tangential carriage mode (i.e., with the pylon struts eliminated);

FIGS. 6A, 6B, 6C and 6D are various views, in simplified pictorial and schematic form, of a variation of the preferred embodiment of my inventive advanced air-to-surface weapon; and FIGS. 7A and 7B are two views, in simplified pictorial and schematic form, of a representative proposed next generation of supercruising tactical fighter aircraft carrying two of my advanced air-to-surface weapons (of the variation kind) in an ultra low drag conformal installation, in a tandem centerline carriage mode.

DESCRIPTION OF THE PREFERRED EMBODIMENT AND VARIATION

Figure 3:
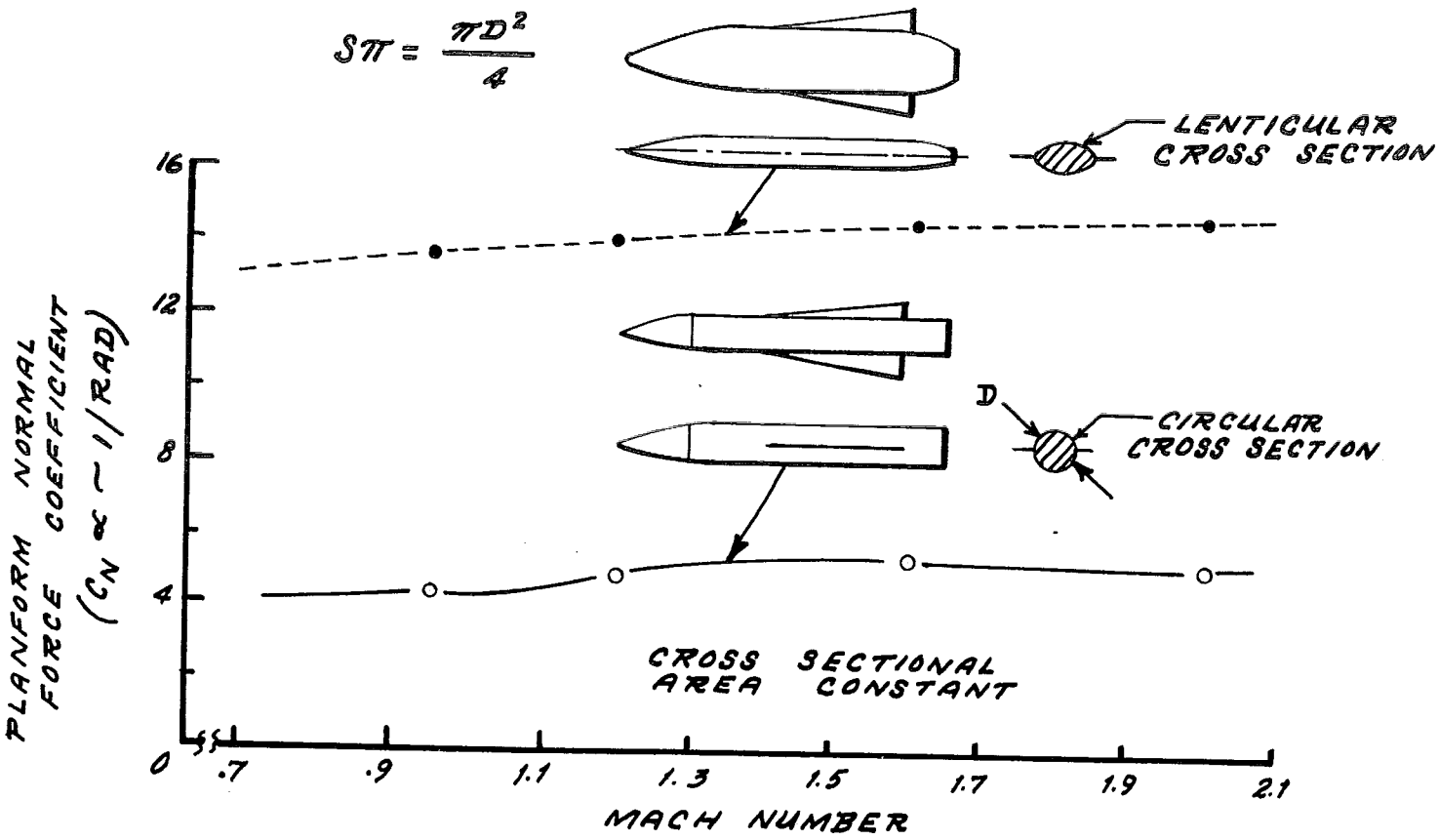
FIG. 3 is a chart which compares planform normal force coefficient as against the Mach number of a conventional air-to-surface weapon wing-body and of an unconventional air-to-surface weapon wing-body, such as my invention, where both weapons have equal cross section.

As a preliminary matter, and with reference to FIGS. 1A, 1B and 2, the data shown therein is the basis for the derivation of my unconventional advanced air-to-surface weapon and of the variation thereof.

In FIGS. 1A and 1B the effect of weapon cross sectional oblateness (i.e., width-to-thickness fineness) is seen to increase the lift coefficient dramatically as a round body of revolution of given area is transformed through an elliptical cross section of equal area to a lenticular (or biconvex) cross section of equal area to, finally, a nearly flat plate. Parasitic drag for a round body without boattailing is chiefly dependent upon forebody shape and fineness ratio. As the round body is transformed to an oblate shape, the inviscid drag decreases rapidly and becomes proportional to thickness squared, reaching asymptotically a theoretical limit of zero for a flat plate.

The effect of cross sectional oblateness on warhead payload capability, which is key to the utility of my unconventional air-to-surface weapon, is illustrated in FIG. 2. Little reduction of warhead payloads is realized for width-to-thickness ratios in the 2.5 range, assuming equal cross sectional area for both round and lenticular shapes. Lift and drag, however, are dramatically influenced upwards and downwards respectively. The important advantages of the lenticular cross section weapon are summarized in FIG. 2.

From the aerodynamic standpoint, the most important of these advantages are the very low weapon drag and relatively high weapon lift obtainable with this approach, small planform area lifting/stabilization/control surfaces, and adaptability to low drag conformal, or tangential carriage, positioning of my inventive weapon. High met maneuverability and good supersonic lift-to-drag ratio give my weapon excellent standoff potential.

Still as a preliminary matter, and with references to FIG. 3, therein are shown estimates of planform normal force coefficient per radian for a conventional wing-body combination (i.e., circular cross section) and for my unconventional wing-body combination (i.e., lenticular cross section). The shape which I have selected for the preferred embodiment, and for the variation thereof, represents a feasible compromise between improved aerodynamic lifting properties on the one hand, and adequate internal volume for warhead and sub-system packaging on the other. Both configurations have equal cross sectional areas, and the wing planforms are identical. The lifting capability of the lenticular shape averages about three times that of the conventional round shape over the flight Mach numbers shown.

Now, with reference to FIGS. 4A, 4B, 4C and 4D which, respectively, are a perspective view, a top plan view, a side elevation view, and a front view of the preferred embodiment 10 of my unconventional advanced air-to-surface weapon.

In the most basic and generic structural form, my weapon 10 comprises a plurality of constituent components which include: a component means (generally designated 20) for guiding and piloting said weapon 10; a component means (generally designated 30) for propelling, stabilizing and controlling the weapon 10, with this means 30 disposed aft of, and associated with, the guiding and piloting means 20; and, a component warhead payload module (generally designated 40) having a forward end 41 and an aft end 42, with this module 40 interposed between, and releasably connected to, the guiding and piloting means 20 at the forward end 41 of the payload module 40, and with the propelling, stabilizing and controlling means 30 at the aft end 42 of the payload module 40. It is to be noted that each of these constitutuent components 20, 30 and 40 of the weapon 10 are combined to form a temporarily integrated (i.e., united), aerodynamically configurated and structured unit 10 which is selectively separable into the constituent components 20, 30 and 40 by suitable conventional means, such as a signal command from a remote source. It is also to be noted that the guiding and piloting means component 20, and the propelling, stabilizing, and controlling means component 30, are each in the form of a module (i.e., a self-contained unit that performs a specific task or class of tasks in support of the major function of the weapon 10), as is the warhead payload component 40.

More specifically, the weapon 10 structurally comprises a forward nose section 20, a midbody portion 40, and an aft boattail portion 30. The forward nose portion 20 comprises the guiding and piloting means modular component (and vice versa), and this modular component 20 has a lenticular (i.e., biconvex) cross section "A", FIG. 4A, that conforms to a Sears-Haack half-body profile of least drag in width and thickness. The midbody portion 40 comprises the warhead payload modular component (and vice versa), and this modular component 40 has a lenticular (i.e., biconvex) cross section "B" this is constant. The aft boattail portion 30 comprises the propelling, stabilizing, and controlling means (and vice versa), and this modular component 30 has a lenticular (i.e., biconvex) cross section "C" that conforms to a Sears-Haack half-body shape in width and thickness, and that has an aft end base 31 that is truncated for, and accepts, a rocket nozzle 51 of a rocket motor 50, FIG. 4D, that is housed in this modular component 30. The weapon 10, as a selectively separable integrated unit, is monowing and has a width-to-thickness fineness (i.e., ratio) of approximately 2.5 (i.e., 2.5-to-1), as is shown in FIG. 4D.

Additionally, the weapon 10 has an exterior skin 60 made of steel alloy; and, the aft boattail portion 30 has a starboard side 32 with a first blended planar wing section 71 attached to it, and a port side 33 with a second blended planar wing section 72 attached to it. It is to be noted that the first 71 and the second 72 blended planar wing sections are symmetrical, are of a clipped delta wing planform, and have a low exposed aspect ratio. Further, each wing section 71 and 72 has a wing tip (i.e., 71A and 72A, respectively) to which is mounted an identical vertical stabilizer/rudder (i.e., 73 and 74, respectively) of delta planform.

With reference to FIGS. 5A, 5B and 5C, therein are, respectively, a side elevation, bottom, and front views of a representative proposed next generation of supercruising tactical fighter aircraft 80 that is carrying four of my weapons 10 in a tangential carriage mode (i.e., with the pylon struts eliminated). It is to be noted that elimination of the pylon struts, coupled with the low free flight drag of the weapon 10, results in low parent aircraft drag increments due to weapon presence.

Now, with reference to FIGS. 6A, 6B, 6C and 6D which, respectively, are a perspective view, a top plan view, a side elevation view, and a front view of a variation 110 of the preferred embodiment of my unconventional advanced air-to-surface weapon 10, FIGS. 4A–4D, inclusive, and 5A–5C, inclusive. It is to be noted that the variation 110 is similar to (and, in fact, almost identical to) the preferred embodiment of my weapon 10, as is indicated and shown by the fact that, whenever applicable, the same reference numerals are used in FIGS. 6A–6D, inclusive, to denote the same components, features and the like. In that regard, it is to be noted that unlike the preferred embodiment 10, the variation 110 has: a semi-lenticular (i.e., one flat side) cross section "D" as is shown in FIG. 6A; a width-to-thickness fineness (i.e., ratio) of approximately 2.1 (i.e., 2.1-to-1), as is shown in FIG. 6D; a forward nose portion 20 that has a starboard side 21 with a first small, fixed-incidence canard fin 23 attached to it, and a port side 22 with a second small, fixed incidence canard fin 24 attached to it, with the first and second canard fins 23 and 24 being symmetrical; and an aft boattail portion 30 that has foldable vertical stabilizers 173 and 174 mounted, respectively, on the wing tips 71A and 72A.

With reference to FIGS. 7A and 7B, therein are, respectively, a top plan view and a front view of the same representative proposed next generation of supercruising tactical fighter aircraft 80 (as is shown in FIGS. 5A–5C, inclusive) that is carrying two of my variations 110 of the weapon 10 (with the vertical stabilizers folded) in an ultra low drag conformal installation, in a tandem center line carriage mode.

It is to be noted that, due to partial deployment of the variation weapon 110 within the aircraft 80, and low energy boundary layer during captive carriage, and also folded vertical fins 173 and 174, the variation weapon 110 has lower carriage drag than the preferred embodiment of the weapon 10, despite having slightly higher free flight drag.

MANNER OF OPERATION AND USE OF THE PREFERRED EMBODIMENT AND VARIATION

The manner of operation and of use of the preferred embodiment of my unconventional advanced air-to-surface weapon 10, FIGS. 4A–4D, inclusive, and FIGS. 5A–5C, inclusive, and of the variation thereof 110, FIGS. 6A–6D, inclusive, and FIGS. 7A and 7B, can be ascertained by any person of ordinary skill in the art from the foregoing description, coupled with reference to the Figures of the drawings.

For others, it is believed necessary to add, to the foregoing description and to the contents of the Figures, the facts that a Sears-Haack body is well known in the art; that it is a body which is symmetrical about the midpoint of its axis; and, that is has the least drag for a given cross sectional area, as a function of the distance (i.e., the length) aft of the nose tip.

CONCLUSION

It is abundantly clear from all of the foregoing, and from the Figures of the drawings, that the stated desired objects, as well as other related objects, of my invention have been achieved. For example, the modular warhead payload component 40, FIGS. 4A–4D, inclusive, and FIGS. 6A–6D, inclusive, is multi-purpose in that it can carry internally and deliver a broad spectrum of bombs including, but not limited to, conventional cluster bombs, homing minimissiles, and runway cutting cluster missiles.

It is to be noted that, although there have been described and shown the fundamental and unique features of our invention as applied to a preferred embodiment 10 and a variation thereof 110, various other embodiments, variations, adaptations, substitutions, additions, omissions, and the like may occur to, and can be made by, those of ordinary skill in the art, without departing from the spirit of my invention.

I claim:

1. An advanced air-to-surface weapon in the structural form of an aerodynamically-configurated, monowinged, temporarily-integrated, selectively-separable unit having a symmetrical high lift lenticular cross section with a width-to-thickness fineness of approximately 2.5, comprising a plurality of constituent components which include:

a. a component means for guiding and piloting said weapon, wherein this component means is in the form of a module, structurally comprises the forward nose portion of said weapon, and has a lenticular cross section with a foreshape conforming to a Sears-Haack half-body profile of least drag in width and thickness;

b. a component means for propelling, stabilizing, and controlling said weapon, wherein this component means is in the form of a module which is disposed aft of and is associated with said guiding and piloting component means, has a lenticular cross sectionn conforming to a Sears-Haack half-body shape in width and thickness and an aft end base which is truncated for a rocket nozzle of a rocket motor housed therein, and structurally comprises the boattail portion of said weapon, with said boattail portion having a starboard side with a first blended planar wing section attached thereat and a port side with a second blended planar wing section attached thereat, wherein said first and second blended planar wing sections are symmetrical, are of a clipped delta wing planform, and have a low exposed aspect ratio, and wherein each said wing section has a wing tip to which is mounted an identical vertical stabilizer/rudder of delta planform; and c. a component warhead payload module having a forward end and an aft end, with this module interposed between, and releasably connected to, said guiding and piloting component means at said forward end of this module and said propelling, stabilizing, and controlling means at said a of this module, and with this module having a lenticular cross section which is constant.

2. An advanced air-to-surface weapon in the structural form of an aerodynamically-configurated monowinged, temporarily-integrated, selectively-separable unit having a semi-linticular cross section with a width-to-thickness fineness of approximately 2.1, comprising a plurality of constituent components which include:

a. a component means for guiding and piloting said weapon, wherein this component means is in the form of a module, structurally comprises the forward nose portion of said weapon, has a semi-lenticular cross section with a foreshape conforming to a Sears-Haack half-body profile of least drag in width and thickness, and has a starboard side with a first small fixed-incidence canard fin attached thereat, and a port side with a second small fixed-incidence canard fin attached thereat, wherein said first and second canard fins are symmetrical;

b. a component means for propelling, stabilizing, and controlling said weapon, wherein this component means is in the form of a module which is disposed aft of and is associated with said guiding and piloting component means, has a semi-lenticular cross section conforming to a Sears-Haack half-body shape in width and thickness and an aft end base which is truncated for a rocket nozzle of a rocket motor housed therein, and structurally comprises the boattail portion of said weapon, with said boattail portion having a starboard side with a first blended clipped delta planform wing section attached thereat, and a port side with a second blended clipped delta planform wing section attached thereat, wherein said first and second wing sections are symmetrical, and wherein each wing section has a wing tip to which is mounted an identical, foldable, vertical stabilizer; and c. a component warhead payload module having a forward end and an aft end, with this module interposed between and releasably connected to, said guiding and piloting component means at said forward end of this module and said propelling, stabilizing and controlling means at said aft end of this module and with this module having a semi-lenticular cross section which is constant.

* * * * *